US007726905B2

(12) United States Patent
Hall et al.

(10) Patent No.: US 7,726,905 B2
(45) **Date of Patent: *Jun. 1, 2010**

(54) ASPHALT RECONDITIONING MACHINE

(76) Inventors: David R. Hall, 2185 S. Larsen Pkwy., Provo, UT (US) 84606; David Wahiquist, 2185 S. Larsen Pkwy., Provo, UT (US) 84606; Timothy Duke, 2185 S. Larsen Pkwy., Provo, UT (US) 84606

( * ) Notice: Subject to any disclaimer, the term of this patent is extended or adjusted under 35 U.S.C. 154(b) by 800 days.

This patent is subject to a terminal disclaimer.

(21) Appl. No.: 11/558,605

(22) Filed: Nov. 10, 2006

(65) Prior Publication Data

US 2008/0056822 A1 Mar. 6, 2008

Related U.S. Application Data

(63) Continuation-in-part of application No. 11/470,570, filed on Sep. 6, 2006, now Pat. No. 7,588,388.

(51) Int. Cl.
*E01C 19/22* (2006.01)
*E01C 19/48* (2006.01)

(52) U.S. Cl. ..... 404/111; 404/101; 404/108; 404/114; 404/118

(58) Field of Classification Search ..... 404/101–118
See application file for complete search history.

(56) References Cited

U.S. PATENT DOCUMENTS

| | | | | |
|---|---|---|---|---|
| 1,898,158 | A | 2/1933 | Winkle | |
| 2,039,078 | A | 4/1936 | Hartwig | |
| 1,887,341 | A | 11/1936 | Venable | |
| 2,098,895 | A | 11/1937 | Velten | |
| 2,633,782 | A | 4/1953 | Clement | |
| 2,893,299 | A | 7/1959 | Moir | |
| 2,908,206 | A | 10/1959 | Melanson | |
| 2,938,438 | A | 5/1960 | Hamilton | |
| 3,075,436 | A | 1/1963 | McRae | |
| 3,361,042 | A | 1/1968 | Cutler | |
| 3,732,023 | A | 5/1973 | Rank | |
| 3,817,644 | A | 8/1974 | Matson | |
| 3,970,404 | A | 7/1976 | Benedetti | |
| 3,989,401 | A | 11/1976 | Moench | |
| 4,018,540 | A | 4/1977 | Jackson | |
| 4,104,736 | A | 8/1978 | Mendenhall | |
| 4,124,325 | A | 11/1978 | Cutler | |
| 4,127,351 | A | 11/1978 | Vural | |
| 4,172,679 | A | 10/1979 | Wirtgen | |
| 4,195,946 | A | 4/1980 | Swisher | |
| 4,215,949 | A | 8/1980 | Gabriel, Jr. | |
| 4,260,203 | A * | 4/1981 | Garner | 384/96 |
| 4,261,669 | A | 4/1981 | Edo | |
| 4,313,690 | A | 2/1982 | Hojbjerg | |

(Continued)

*Primary Examiner*—Raymond W Addie
(74) *Attorney, Agent, or Firm*—Tyson J. Wilde

(57) ABSTRACT

An apparatus for reconditioning a paved surface includes a vehicle adapted to traverse the paved surface. The vehicle has a manifold with a plurality of jets disposed within a surface adjacent the paved surface and at least one of the jets has a high temperature, high pressure nozzle. The high temperature, high pressure nozzle has a hard material with a hardness of at least 2,000 HK. The jets are in fluid communication with a fluid reservoir through a fluid pathway, and the fluid pathway has a pressurizing mechanism and a heating mechanism for bringing the fluid to a high temperature and a high pressure.

20 Claims, 12 Drawing Sheets

U.S. PATENT DOCUMENTS 4,335,975 A 6/1982 Schoelkopf
4,347,016 A 8/1982 Sindelar et al.
4,407,605 A 10/1983 Wirtgen
4,473,320 A 9/1984 Register
4,534,674 A 8/1985 Cutler
4,594,022 A 6/1986 Jeppson
4,668,017 A 5/1987 Petersen
4,676,689 A 6/1987 Yant
4,692,350 A 9/1987 Clarke
4,784,518 A 11/1988 Cutler
4,793,730 A 12/1988 Butch
4,968,101 A 11/1990 Bossow
5,026,205 A 6/1991 Gorski
5,131,788 A 7/1992 Hulicsko
5,366,320 A 11/1994 Hanlon
5,556,225 A 9/1996 Marino
5,735,634 A * 4/1998 Ulrich et al. ..... 404/102
5,765,926 A 6/1998 Knapp
5,791,814 A 8/1998 Wiley
5,851,085 A * 12/1998 Campbell ..... 404/75
5,947,636 A 9/1999 Mara
5,947,638 A 9/1999 Heims
5,951,561 A 9/1999 Pepper
6,122,601 A 9/2000 Swanson
6,158,920 A 12/2000 Malot
6,287,048 B1 9/2001 Hollon
6,371,689 B1 4/2002 Wiley
6,551,018 B2 4/2003 Baker
6,577,141 B2 6/2003 Gandrud
6,623,207 B2 9/2003 Grubba
6,769,836 B2 8/2004 Lloyd
6,799,922 B2 10/2004 Smith
6,846,354 B2 1/2005 Larsen
7,094,001 B2 * 8/2006 Wills ..... 404/75
7,588,388 B2 * 9/2009 Hall et al. ..... 404/111
2006/0049282 A1 * 3/2006 Bowman et al. ..... 239/494

* cited by examiner

ASPHALT RECONDITIONING MACHINE

CROSS REFERENCES

This application is a Continuation-in-Part of U.S. patent Ser. No. 11/470,570, now U.S. Pat. No. 7,588,388 issued on Sep. 15, 2009, filing date Sep. 6, 2006 now U.S. Pat. No. 7,588,388 and titled A Paved Surface Reconditioning System, which is herein incorporated by reference for all that it contains.

BACKGROUND OF THE INVENTION

Modern road surfaces typically comprise a combination of aggregate materials and binding agents processed and applied to form a smooth paved surface. The type and quality of the pavement components used, and the manner in which the pavement components are implemented or combined, may affect the durability of the paved surface. Even where a paved surface is quite durable, however, temperature fluctuations, weather, and vehicular traffic over a paved surface may result in cracks and other surface or sub-surface irregularities over time. Road salts and other corrosive chemicals applied to the paved surface, as well as accumulation of water in surface cracks, may accelerate pavement deterioration.

Road resurfacing equipment may be used to mill, remove, and/or recondition deteriorated pavement. In come cases, heat generating equipment may be used to soften the pavement, followed by equipment to mill the surface, apply pavement materials, and plane the surface. Often, new pavement materials may be combined with materials milled from an existing surface in order to recondition or recycle existing pavement. Once the new materials are added, the materials may be compacted and planed to restore a smooth paved surface.

U.S. Pat. No. 4,793,730 which is herein incorporated by reference for all that it contains, discloses a method and apparatus for renewing the surface of asphaltic paving at low cost and for immediate reuse. The asphalt surface is heated to about 300.degree.-500.degree. F. The surface is broken to a depth of about two inches and the lower material thoroughly mixed in situ with the broken surface material. After mixing, the material is further heated to fuse the heated mixture into a homogeneous surface. The surface is screeded for leveling and compacted by a road roller. A road machine is disclosed having a steam manifold for heating the asphalt, transversely reciprocating breaker bars having teeth adjusted to the depth desired, toothed mixing cylinders for mixing the broken material, and a second steam manifold for reheating the mixed material. Reciprocating screed bars on the road machine level the mixed and heated material. Final compacting may be done with a conventional road roller.

U.S. Pat. No. 4,261,669 which is herein incorporated by reference for all that it discloses, teaches a method and apparatus for repairing asphalt concrete road surfaces wherein a tractor a steam box and a car mounted with a screw cutter are coupled in this order and a series of linearly operated equipment is used on the asphalt concrete paved road surface, including a heater car, an asphalt finisher and a road roller in this order after the car. Each of the equipment is made to advance at low speed and the asphalt concrete paved road surface is artificially heated by the steam box to impart fluidity to the road surface, after which it is cut with the screw cutter and the cut asphalt concrete is conveyed into a heating chamber of the heater car, and water content in the asphalt concrete is removed by heating and stirring. The resulting asphalt concrete is adjusted to an optimum temperature suitable for asphalt concrete paving, and then is discharged from the heating chamber, and charged onto the surface of the cut road directly and thereafter the asphalt concrete paved road surface is treated by using the asphalt finisher and the road roller.

U.S. Pat. No. 5,486,554 which is herein incorporated by reference for all that it contains, discloses that a low cost method for preparing foamed or aerated asphalt-rubber paving compositions is provided wherein a flowable mixture including respective quantities of asphalt and finally divided reclaimed rubber particles is first directed into a rocket-type reactor along with steam and/or water, thereby subjecting the mixture to conditions of elevated temperature, pressure and shear. Thereafter, the initially reacted mixture is passed into a pressurized, secondary reaction vessel system in order to complete the gelation reaction in a period of, e.g., 7-15 minutes. The preferred apparatus includes; a rocket-type primary reactor presenting a confined reaction zone; asphalt-rubber and water/steam conduits communicate with the zone. The output of the primary reactor feeds directly into a pressurized tank forming a part of the downstream secondary reaction and recovery system, where the gelation reaction is completed. The preferred system includes a total of five serially interconnected tanks housed within an insulative shell and heated by means of burner.

U.S. Pat. No. 4,592,507 which is herein incorporated by reference for all that it contains, discloses an apparatus and a method for coating a road surface with bitumen binder material. The apparatus includes distribution conduit members for conducting bitumen material in a fluid state from a continuous source thereof and distribution conduit members for conducting gas, preferably steam, from a continuous source thereof. Pluralities of mixer housings are joined to the conduit members and receive bitumen binder material and gas. The apparatus is carried by a vehicle which travels over a road surface. The bitumen binder material and the gas are mixed and sprayed upon the road surface as the vehicle travels over the road surface.

U.S. Pat. No. 5,324,136 which is herein incorporated by reference for all that it contains, discloses an apparatus for spreading a fluid or similar substance, especially a bonding emulsion for road asphalt onto the surface of a road, comprising, on a movable vehicle, at least one spreading boom, along which the spreading is carried out at least partially, said boom being associated with at least one ejection nozzle and with a feed circuit and being capable of being displaced relative to the movable vehicle transversely to the direction of movement of the latter, and is associated with motor means intended for driving it in displacement, during spreading, in a to-and-fro movement. The machine of the finisher type comprises such an apparatus.

U.S. Pat. No. 5,279,500 which is herein incorporated by reference for all that it contains, discloses an apparatus for spreading a fluid or like substance, for example, an emulsion for bonding bituminous coated material on the surface of a road including a mobile machine, at least one spreading bar along which the spreading is at least partially effected, and at least one ejection nozzle associated with the at least one spreading bar. A supply circuit may supply emulsion to the nozzle. The at least one nozzle is associated with a mechanism for controlling delivery of the emulsion and a mechanism for controlling positioning of the nozzle relative to the machine. Both of the mechanisms are operated simultaneously, in dependence on the movement of the mobile machine, in such a manner that the nozzle effects spraying by sequenced jets of the substance to continuously cover the surface which is to be spread. The machine provided with this apparatus is of the finisher type.

BRIEF SUMMARY OF THE INVENTION

An apparatus for reconditioning a paved surface includes a vehicle adapted to traverse the paved surface. The vehicle has a manifold with a plurality of jets disposed within a surface adjacent the paved surface and at least one of the jets has a high temperature, high pressure nozzle. The high temperature, high pressure nozzle has a hard material with a hardness of at least 2,000 HK. The jets are in fluid communication with a fluid reservoir through a fluid pathway, and the fluid pathway has a pressurizing mechanism and a heating mechanism for bringing the fluid to a high pressure and a high temperature. The vehicle may further comprise a compactor.

The manifold may comprise a depressurization chamber rearward of the jets. The manifold may comprise at least one projection intermediate the jets and the depressurization chamber adapted to further pressurize a portion of the paved surface.

The pressurizing mechanism may be a pump. The fluid pathway may comprise a check valve. The fluid pathway may be in communication with a second fluid reservoir. The fluid pathway may comprise an agitator for mixing fluid from both reservoirs together. One of the reservoirs may comprise water and the other reservoir may comprise oils, maltenes, asphaltenes, surfactants, zeolites, polymers, rubbers, waxes, foaming agents, or combinations thereof.

The nozzles may be flush with the surface of the manifold. A gap may exist between the surface of the manifold and nozzle, wherein the gap is less than 10 mm. The nozzle may comprise a steel housing with a bore and a first diameter and a second diameter, wherein the second diameter is narrower than the first diameter and the hard material is disposed within the second diameter; the second diameter being adjacent the surface of the manifold.

The hard material may be selected from the group consisting of diamond, monocrystalline diamond, polycrystalline diamond, sintered diamond, chemical deposited diamond, physically deposited diamond, natural diamond, infiltrated diamond, layered diamond, thermally stable diamond, silicon bonded diamond, metal bonded diamond, cubic boron nitride, silicon carbide, diamond impregnated matrix, diamond impregnated carbide, and combinations thereof.

A method for reconditioning a paved surface of aggregate and asphalt cement may comprise the steps of providing a vehicle adapted to traverse the paved surface. The vehicle comprises a manifold with a plurality of jets disposed within a surface adjacent the paved surface, at least one of the jets comprising a high temperature, high pressure nozzle; pressurizing the paved surface by forcing the manifold against the paved surface and injecting a hot, pressurized rejuvenation material into the paved surface through the jets; coating a surface area of the aggregate with the rejuvenation material by suddenly depressurizing the paved surface; and compacting the depressurized paved surface.

The method may include a further step of heating the paved surface before the jets by allowing a portion of the rejuvenation material to turn into steam and travel forward in the direction of the vehicle's travel along the surface of the manifold. The depressurizing the paved surface may happen behind the manifold or with a depressurization chamber formed in the manifold. The method further may comprise capturing and condensing a portion of the rejuvenation material during the step of depressurizing the paved surface. The remaining portion of the rejuvenation material may coat the aggregate of the paved surface.

A method for reconditioning a paved surface of aggregate and asphalt cement, comprising the steps of providing a vehicle adapted to traverse the paved surface; the vehicle comprising a manifold with a plurality of jets disposed within a surface adjacent the paved surface, at least one of the jets comprising a high temperature, high pressure nozzle; pressurizing the paved surface by forcing the manifold against the paved surface and injecting a hot, pressurized fluid into the paved surface through the jets; separating the aggregate from the asphalt cement by suddenly depressurizing the paved surface; adding rejuvenation material to the depressurized paved surface; and compacting the depressurized paved surface. The step of adding rejuvenation material may take place in a depressurization chamber formed in the manifold.

DETAILED DESCRIPTION OF THE INVENTION AND THE PREFERRED EMBODIMENT

Figure 1:
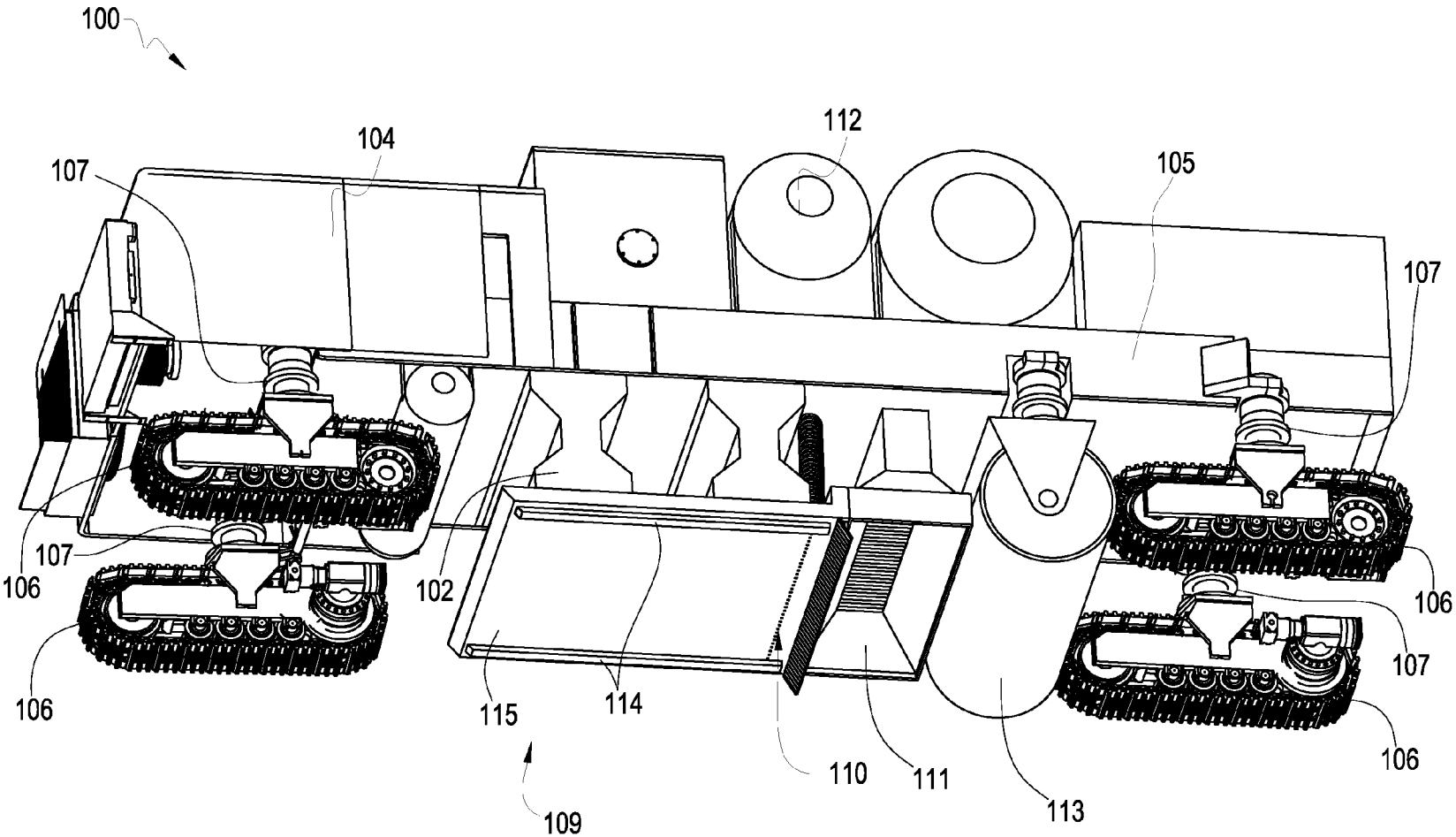
FIG. 1 is a perspective diagram of an embodiment of an asphalt reconditioning machine.

Referring to the asphalt reconditioning machine in the embodiment of FIG. 1, a motorized vehicle 100 may include a shroud 104 covering various internal components of the motorized vehicle 100, a frame 105, and a translational element such as tracks 106, wheels, or the like, to translate or move the vehicle. The motorized vehicle 100 may also include a mechanism 107 for adjusting the elevation and slope of the frame relative to the translational element 106 to adjust for varying elevations, slopes, and contours of an underlying paved surface.

The vehicle comprises a manifold 109 beneath the frame 105 of the vehicle 100. The manifold 109 may be attached to the frame 105 by beams 102 such that the manifold 109 is pressed down against the paved surface when the machine is in operation. The manifold 109 may alternatively be attached to the frame 105 by an actuator which may adjust the vertical position of the manifold 109.

The manifold 109 comprises a plurality of jets 110 disposed within a surface adjacent the paved surface. At least one of the jets 110 has a high temperature, high pressure nozzle. The manifold 109 may also comprise a depressurization chamber 111 rearward of the jets 110. The jets 110 emit a fluid under high temperature and high pressure onto the asphalt such that the asphalt depressurizes within the depressurization chamber 111. When the asphalt depressurizes, aggregate in the asphalt separates from asphalt cement and the aggregate is coated with a rejuvenation material to be re-paved. The vehicle 100 may comprise at least one container, such as a storage tank, where one or more fluid reservoirs 112 are contained. The vehicle 100 may also comprise a compactor 113 rearward of the manifold 109. The compactor 113 compresses the depressurized asphalt back down onto the road surface.

The manifold 109 may comprise one or more strips 114 which, when pressed firmly against the paved surface, act as seals to keep the heat and pressure underneath the manifold due to the fluid contained within an area on an underside 115 of the manifold 109. In this manner, the area of pressurized asphalt may be accordingly increased or decreased. The strips 114 may comprise a hard material such as tungsten carbide to prevent wear.

Figure 2:
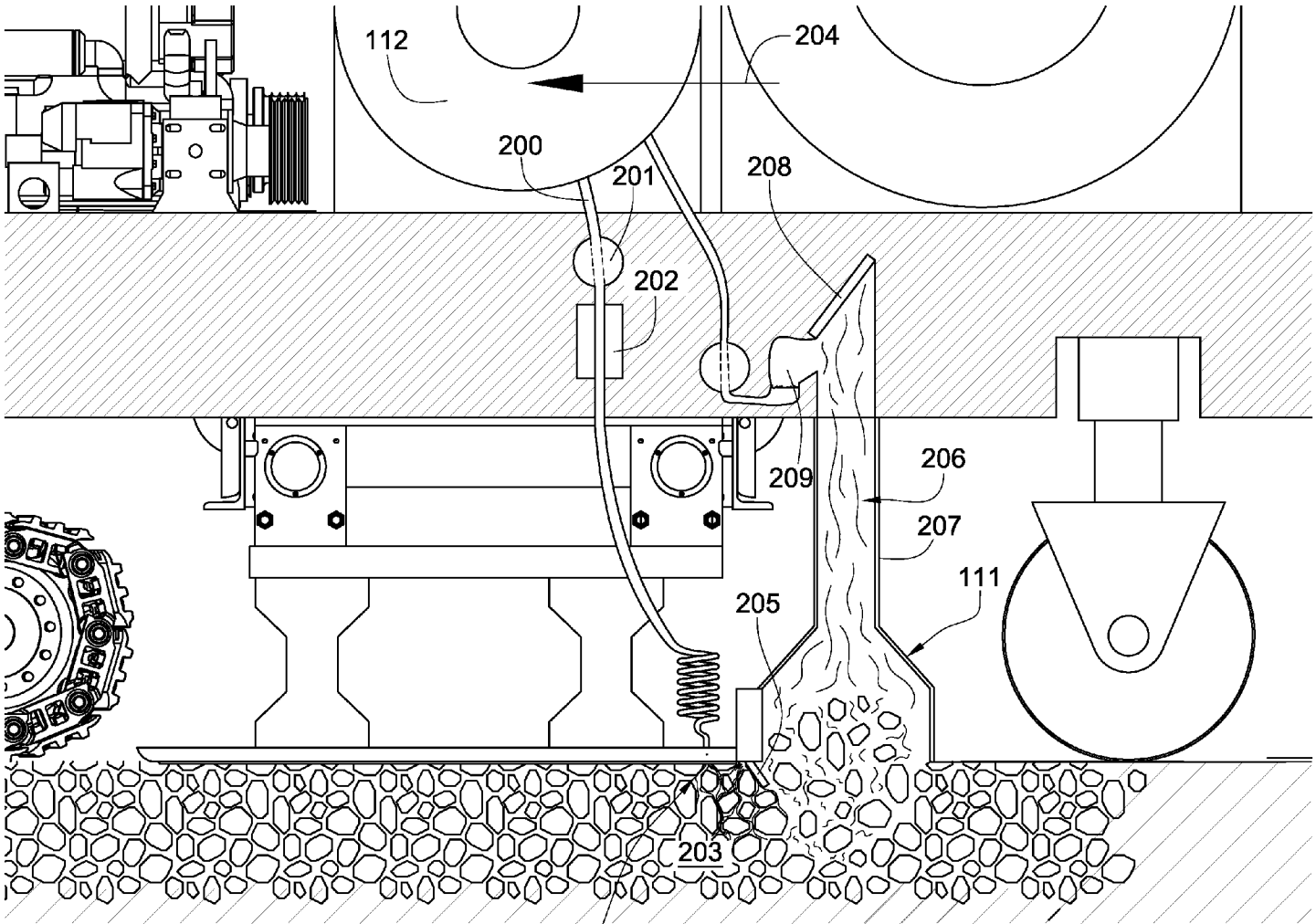
FIG. 2 is a cross-sectional diagram of an embodiment of an asphalt reconditioning system.

Referring now to FIG. 2, the jets are in fluid communication with a fluid reservoir 112 through a fluid pathway 200. The fluid pathway 200 comprises a pressurization mechanism 201, such as a pump, and a heater 202 which pressurize and heat the fluid to high pressure and high temperature in the pathway 200 before it reaches the jets 110. The emitted fluid exerts a force on the asphalt surface 203 in a downward and/or outward direction The force on the asphalt surface 203 provided by the manifold forces the emitted fluid into the asphalt surface where it is contained until the depressurization chamber 111 moves above it, wherein the asphalt surface 203 thereby releases the pressure, causing the asphalt surface 203 to expand upward and explode as the vehicle 100 moves in the direction indicated by the arrow 204.

The asphalt reconditioning machine may comprise at least one projection 205 intermediate the jets 110 and the depressurization chamber 111 adapted to further pressurize a portion of the paved surface. Preferably, the jets 110 operate continuously while traversing the paved surface such that the pressure is constantly high enough to cause the asphalt to depressurize and explode more effectively. Because the jets 110 are operating continuously at high pressure, the fluid may create grooves in the surface of the asphalt. In order to maintain the high pressure on the asphalt surface, the projections may be adapted to fit within the grooves formed in the asphalt and hold the pressure in.

The fluid emitted from the jets may comprise water, oils, maltenes, asphaltenes, surfactants, zeolites, polymers, rubbers, waxes, foaming agents, or combinations thereof. When the asphalt depressurizes into the depressurization chamber 111, the fluid may be generally uniformly mixed among the depressurized asphalt. Also, because of the high temperature of the fluid, when the fluid reaches the depressurization chamber 111, some of the fluid may be evaporated and sent back to the fluid reservoir to be reused. When the vapor 206 reaches a top 208 of a fume chute 207 attached to the depressurization chamber 111, the vapor condenses and pools in a separate chamber 209 which is then pumped back into the fluid reservoir 112. The top 208 of the fume chute 207 may be cooled to aid the condensation of the vapor.

Figure 3:
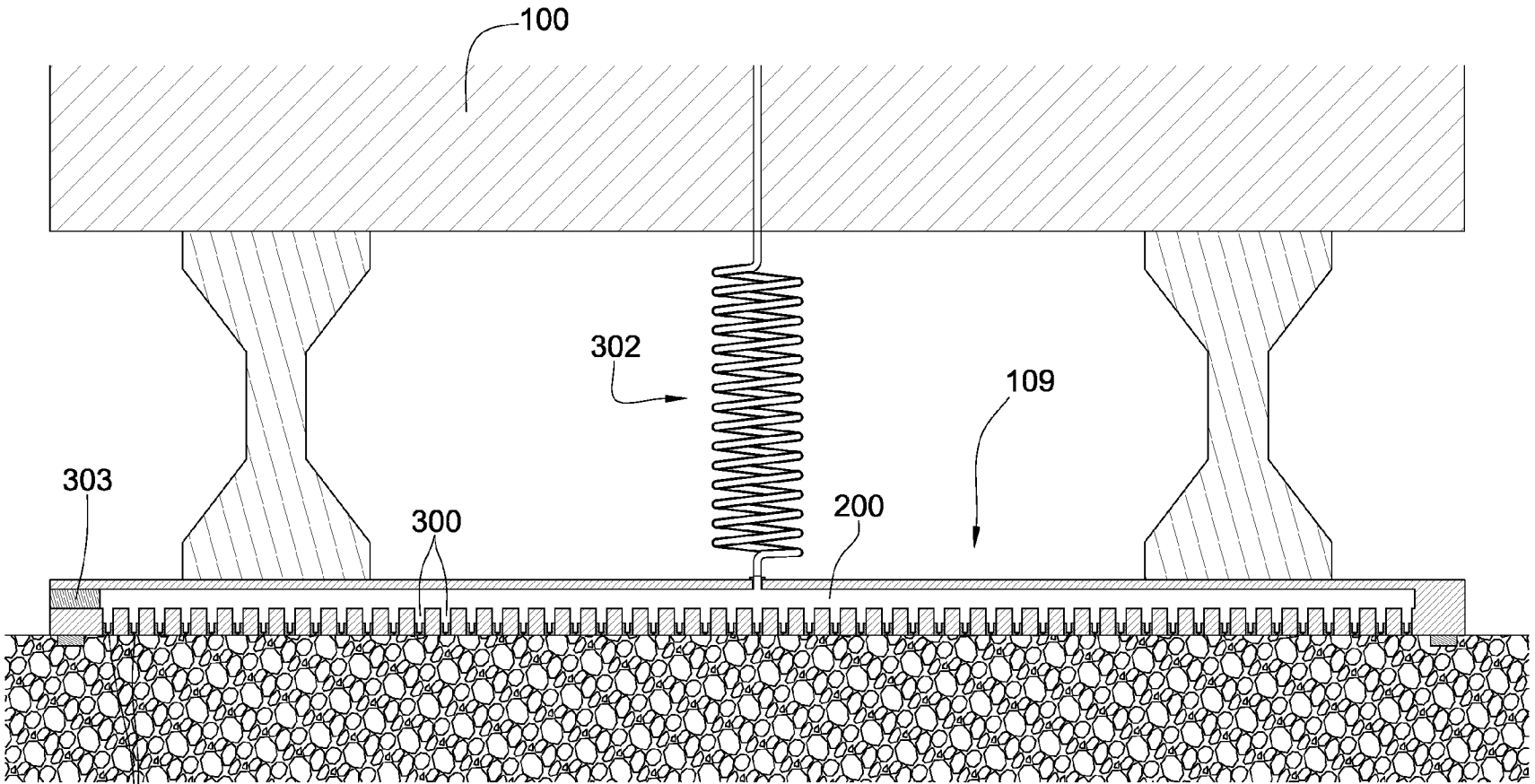
FIG. 3 is a cross-sectional diagram of another embodiment of an asphalt reconditioning system.

The fluid pathway 200 comprises a plurality of channels 300 in the manifold 109, each ending in a nozzle 301, as in the embodiment of FIG. 3. There may be between 35 and 100 individual channels 300 in the fluid pathway 200. The channels 300 may each be spaced a distance of 1 mm to 5 mm apart. The fluid pathway 200 may be about 0.5 to 1 inch in diameter. A portion 302 of the fluid pathway 200 may be coiled between the vehicle 100 and the manifold 109. This may allow for some bending or stretching of the fluid pathway 200 due to possibly varying geometries of the paved surface.

The fluid pathway 200, along with the channels 300 wherein the nozzles 301 are disposed, may be drilled into the manifold 109. Unused portions of the pathway or channels where drilling was started may comprise stops 303 and/or seals such that none of the fluid or pressure exits through the unused portions.

Figure 4:
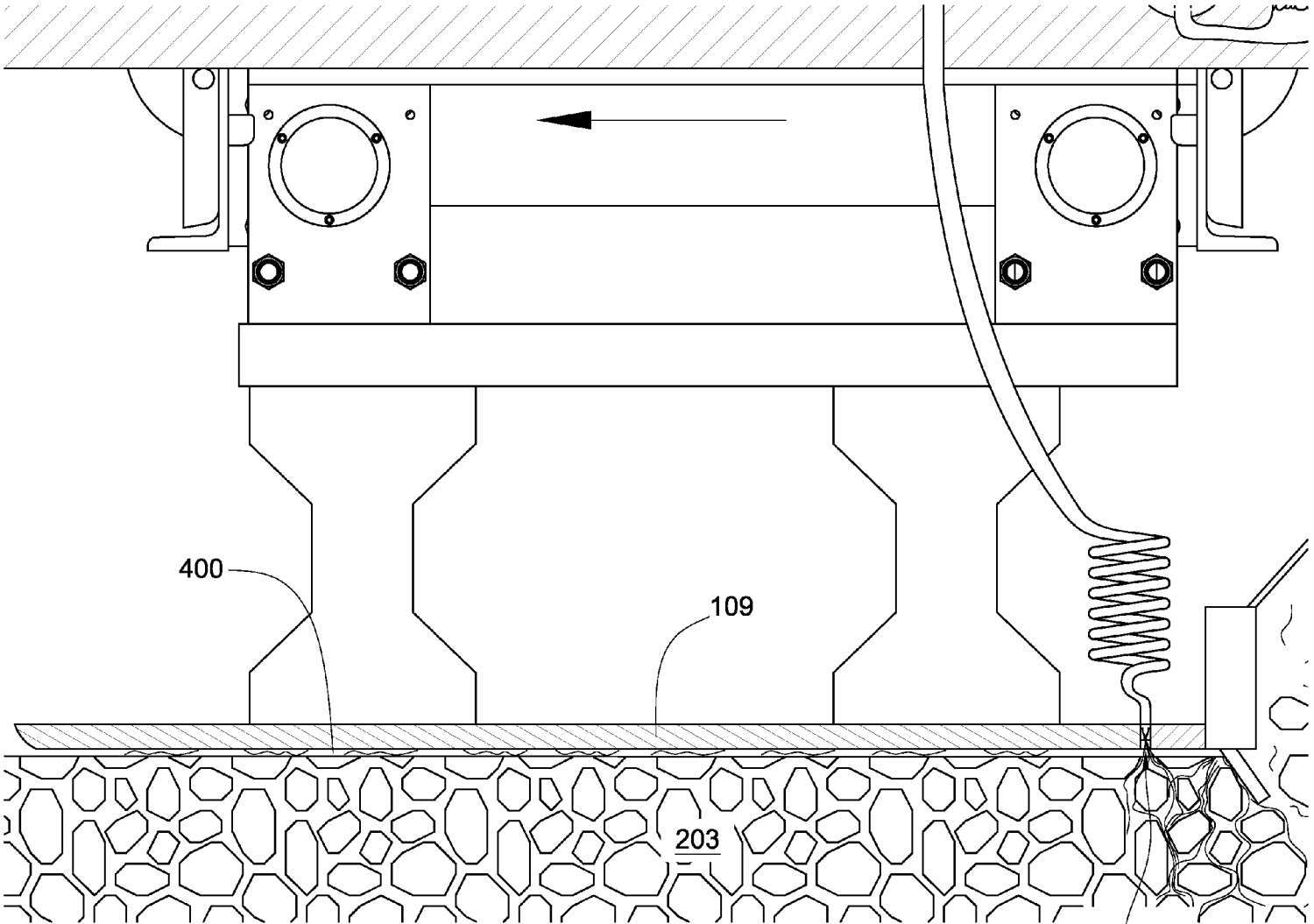
FIG. 4 is a cross-sectional diagram of another embodiment of an asphalt reconditioning system.

Referring now to FIG. 4, a gap 400 may exist between the underside 115 of the manifold 109 and the paved surface 203. This may allow a small amount of the pressure and heat due to the fluid to advance forward underneath the manifold 109, which may heat the paved surface 203 in advance of reaching the jets 110, softening the paved surface 203 and making it easier for the fluid to enter into the asphalt and cause it to expand.

Figure 5:
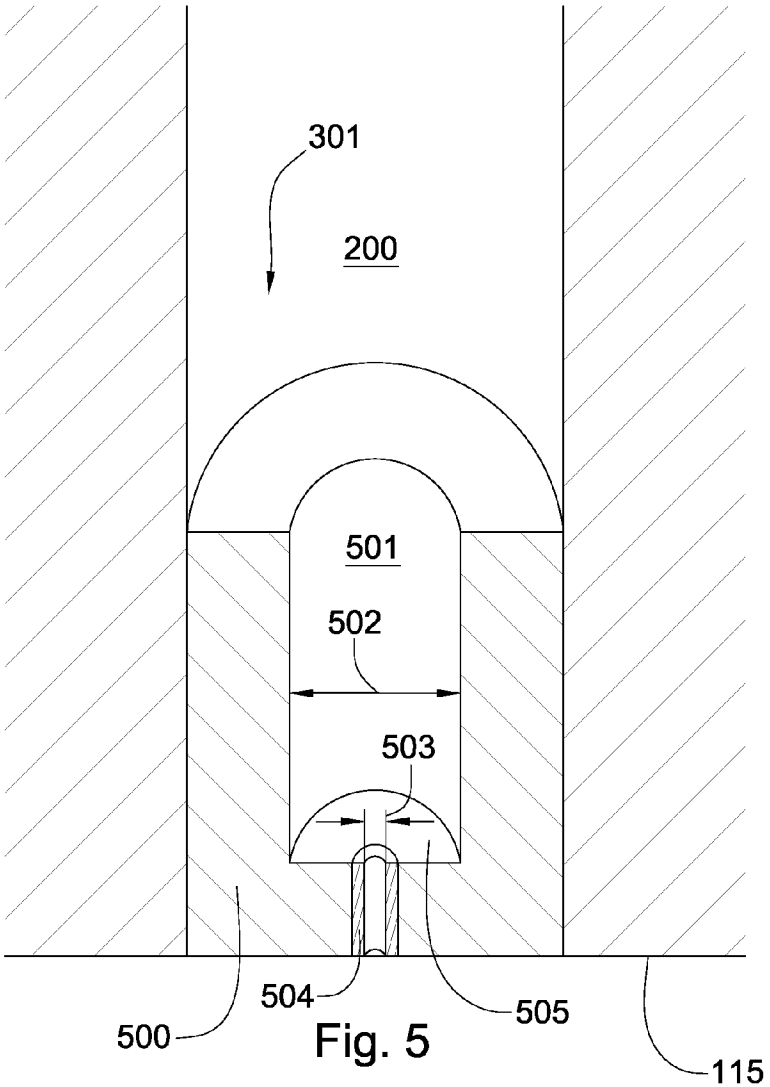
FIG. 5 is a cross-sectional diagram of an embodiment of a nozzle.
Figure 7:
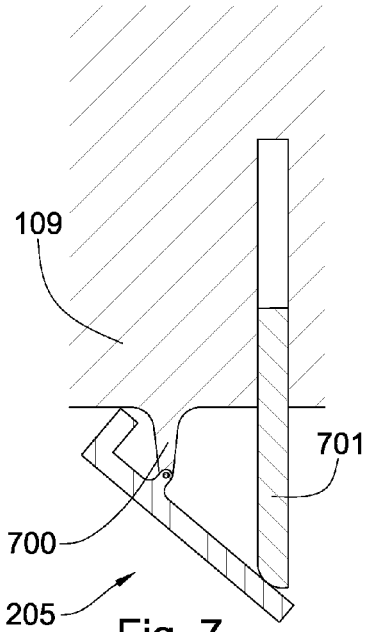
FIG. 7 is a cross-sectional diagram of an embodiment of a projection.
Figure 8:
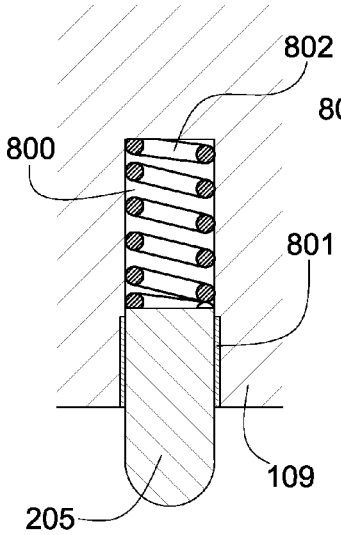
FIG. 8 is a cross-sectional diagram of another embodiment of a projection.
Figure 9:
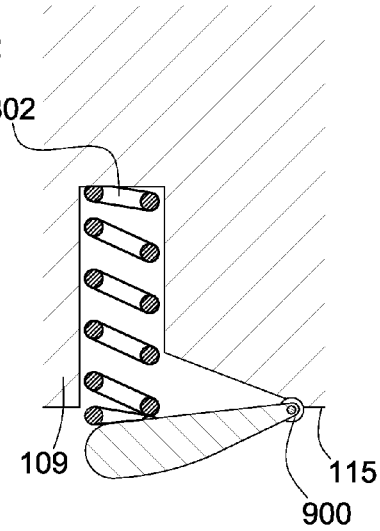
FIG. 9 is a cross-sectional diagram of another embodiment of a projection.

FIG. 5 shows an embodiment of a high temperature, high pressure nozzle 301 in the fluid pathway 200 which may be used in the current invention. The nozzle may be flush with the underside surface 115 of the manifold. The nozzle 301 may be adapted to emit a fluid at a temperature of up to 500 F and at a temperature of up to 20,000 PSI. The nozzle 301 may comprise a steel housing 500 with a bore 501 with a first diameter 502 and a second diameter 503, wherein the second diameter 503 is narrower than the first diameter 502 and is located proximate the outlet of the nozzle 301. The first diameter 502 may allow fluid to enter the nozzle 301 from the pathway 200, while the second diameter 503 allows the nozzle 301 to keep the fluid at a high pressure upon exiting the pathway. The second diameter 503 comprises a hard material 504 of at least 2,000 HK. The hard material 504 may be brazed or press fit into the bore 501. The hard material 504 may be selected from the group consisting of diamond, monocrystalline diamond, polycrystalline diamond, sintered diamond, chemical deposited diamond, physically deposited diamond, natural diamond, infiltrated diamond, layered diamond, thermally stable diamond, silicon bonded diamond, metal bonded diamond, cubic boron nitride, silicon carbide, diamond impregnated matrix, diamond impregnated carbide, and combinations thereof. The second diameter 503 is preferably about 0.003 inches.

Figure 6:
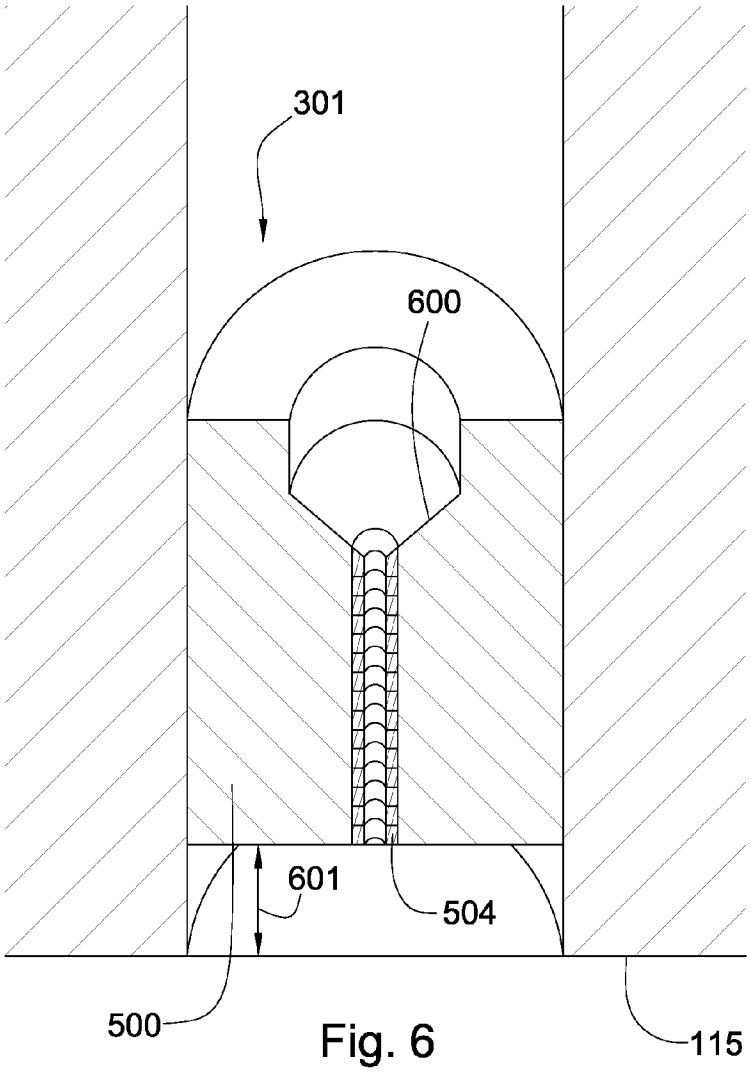
FIG. 6 is a cross-sectional diagram of another embodiment of a nozzle.

The transition from the first, larger diameter 502 to the second, smaller diameter 503 may be an abrupt change 505, as in the embodiment of FIG. 5, or it may be a gradual taper 600, as in the embodiment of FIG. 6. The gradual taper 600 may reduce the erosive forces of the fluid on the nozzle 301 and on the bond between the steel housing 500 and the hard material 504 by aiding the flow of the fluid. A gap 601 may exist between the underside 115 of the manifold 109 and the nozzle 301, which may protect the nozzle 301 from being damaged by the paved surface. The gap 601 may be less than 10 mm. The hard material 504 in the narrow diameter may be segmented. The large diameter of FIG. 5 may be formed with an electric discharge machine and the smaller diameter 503 may be formed with a laser.

Figure 10:
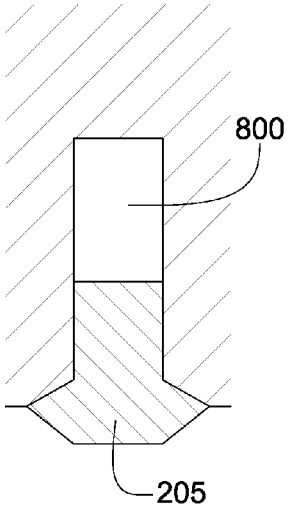
FIG. 10 is a cross-sectional diagram of another embodiment of a projection.
Figure 11:
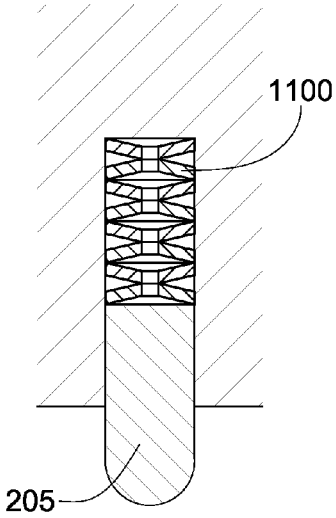
FIG. 11 is a cross-sectional diagram of another embodiment of a projection.
Figure 12:
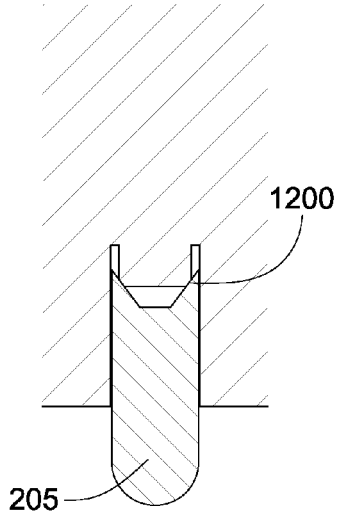
FIG. 12 is a cross-sectional diagram of another embodiment of a projection.

FIGS. 7 through 12 are embodiments of the projection. The projection 205 may be attached to the manifold 109 by a hinged mechanism 700, as in the embodiment of FIG. 7. Due to the force exerted on the projection 205 by the paved surface, the projection 205 may be stabilized by support members 701 also extending from the manifold 109. The projection 205 may be disposed within a pocket 800 in the manifold, as in the embodiment of FIG. 8. The pocket 800 in the manifold 109 may comprise a seal 801 around the projection 205 so that no pressure is allowed to escape into the pocket 800. The projection may also be pressed against the paved surface by a coiled spring 802 within the pocket. The projection 205 may be attached to the underside 115 of the manifold 109 at one end by a pivot 900 while being pressed against the paved surface by a coiled spring 802 at an opposite end, as in the embodiment of FIG. 9. This may be advantageous since it presents a larger surface area to the paved surface and may more easily ride up objects in the paved surface such as manholes. FIG. 10 is an embodiment of a projection 205 that is pressed against the paved surface by hydraulic forces in the pocket such as liquid or gas. The projection 205 may be pressed against the paved surface by a Belville spring 1100, as in the embodiment of FIG. 11, or by hoop tension 1200, as in the embodiment of FIG. 12.

Figure 13:
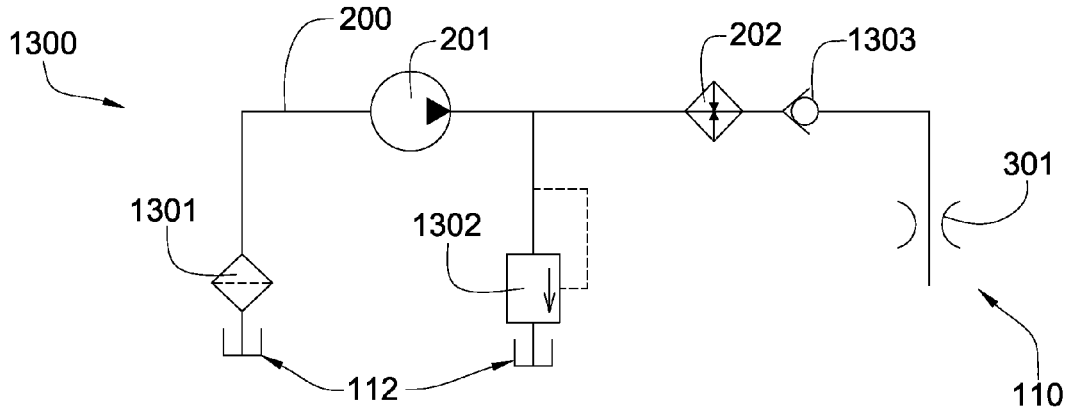
FIG. 13 is a schematic diagram of an embodiment of an asphalt reconditioning system.

A schematic diagram 1300 of one embodiment of the asphalt reconditioning system is shown in FIG. 13, wherein a fluid reservoir 112 is in communication with a jet 110 through a fluid pathway 200. The system may comprise a single fluid reservoir 112, which may hold water for cleaning the paved surface. The fluid reservoir may be followed by a filter 1301 to remove any impurities from the fluid to prevent buildup in the fluid pathway 200 and to prevent the impurities from getting into the asphalt. A pressurizing mechanism 201 designed to pressurize the fluid to a pressure up to 20,000 PSI may follow the filter 1301. The system also comprises a heating mechanism 202 designed to heat the fluid to a temperature up to 500 F, which may follow the pump 201. An overflow system 1302 may also be connected to the fluid pathway 200 between the pump 201 and the heater 202 in order to release any excess fluid pressure back to the fluid reservoir 112. The fluid pathway 200 may also comprise a check relief valve 1303 which allows the fluid to pass through to the nozzle 301 at a certain amount of pressure and which maintains the rest of the fluid at a different pressure.

Figure 14:
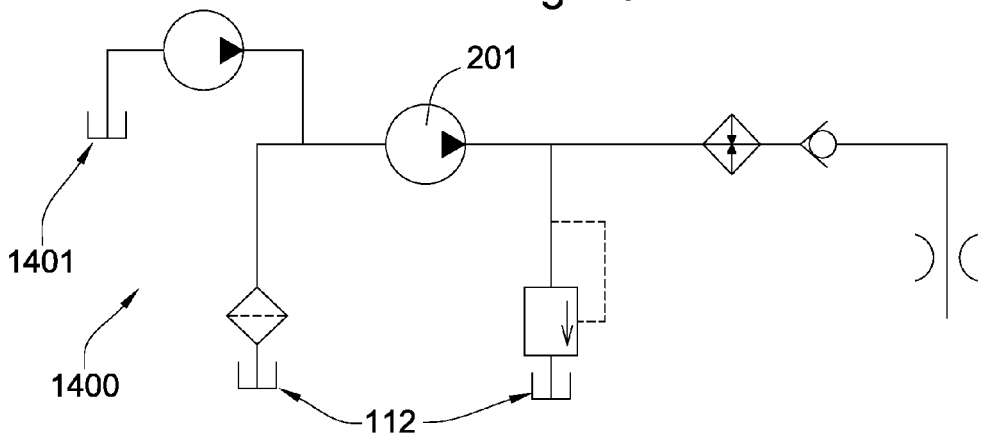
FIG. 14 is a schematic diagram of another embodiment of an asphalt reconditioning system.
Figure 15:
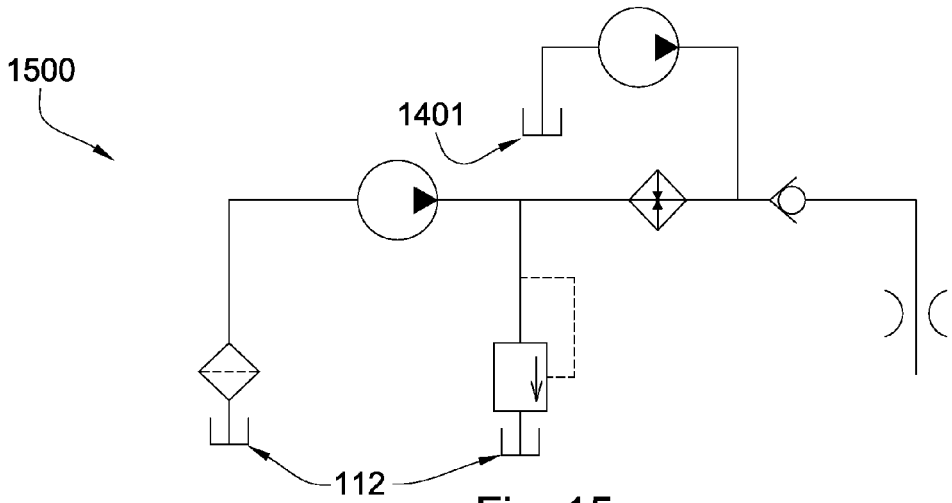
FIG. 15 is a schematic diagram of another embodiment of an asphalt reconditioning system.

FIG. 14 shows a schematic 1400 of an embodiment of the asphalt reconditioning system which comprises two fluid reservoirs 112, 1401, one 112 which holds water and a second 1401 which holds a rejuvenation material, wherein the fluid from the second reservoir 1401 is pressurized before mixing with the water. The mixture then passes through a pressurization mechanism 201. FIG. 15 also shows a schematic 1500 of a system which comprises two reservoirs 112, 1401, wherein the rejuvenation material is mixed with the water after the water has been heated.

Figure 16:
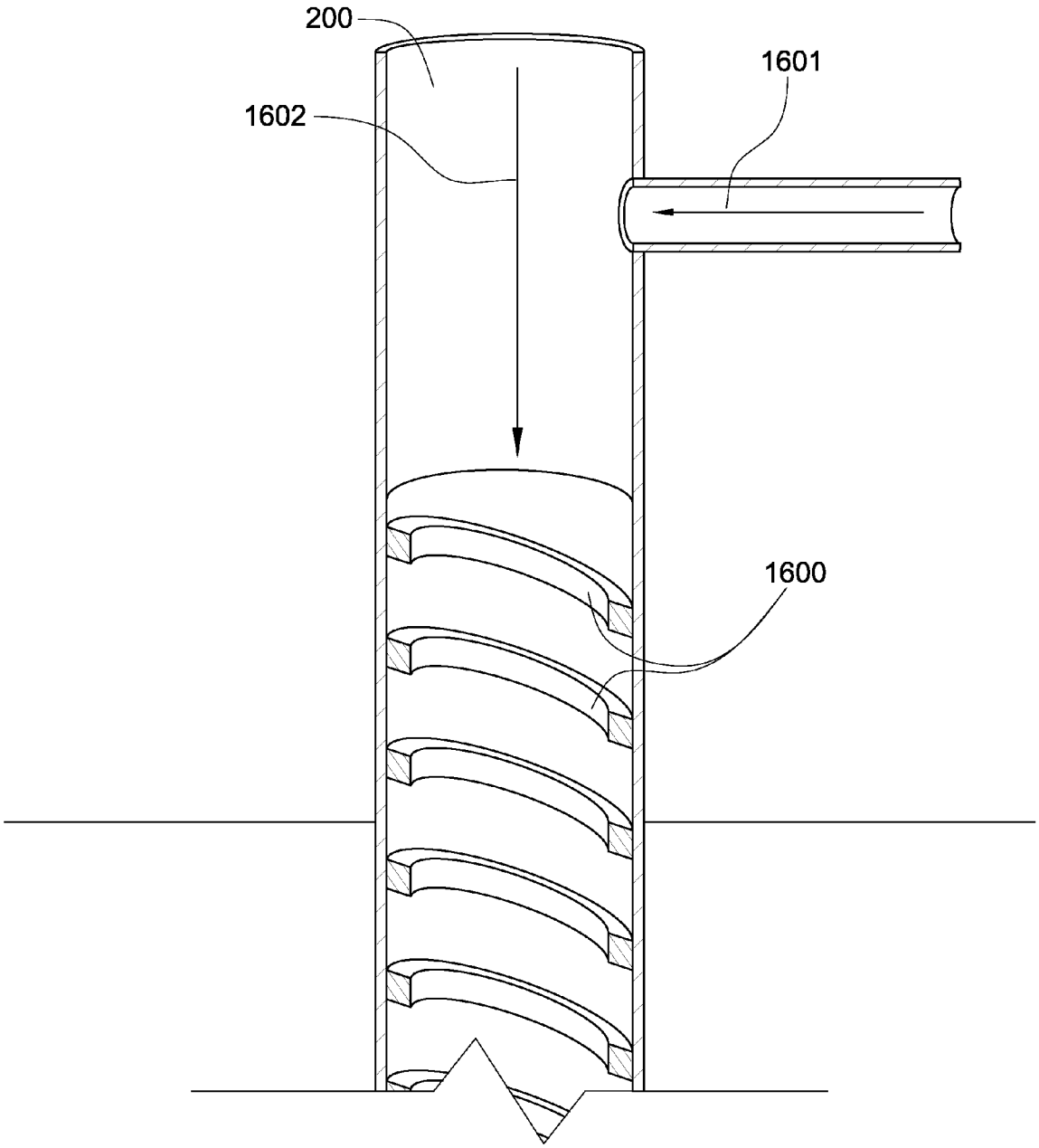
FIG. 16 is a cross-sectional diagram of an embodiment of a fluid pathway.

Referring now to FIG. 16, the fluid pathway 200 may comprise an agitator 1600 for mixing the fluids from the two different reservoirs together. The fluid 1601 from the second reservoir combines with the fluid 1602 from the first reservoir, wherein the fluids pass through the agitator 1600. The agitator 1600 may be a series of ribs or other obstructions positioned in the pathway 200 to disrupt the flow of the fluids, causing them to mix together.

Figure 17:
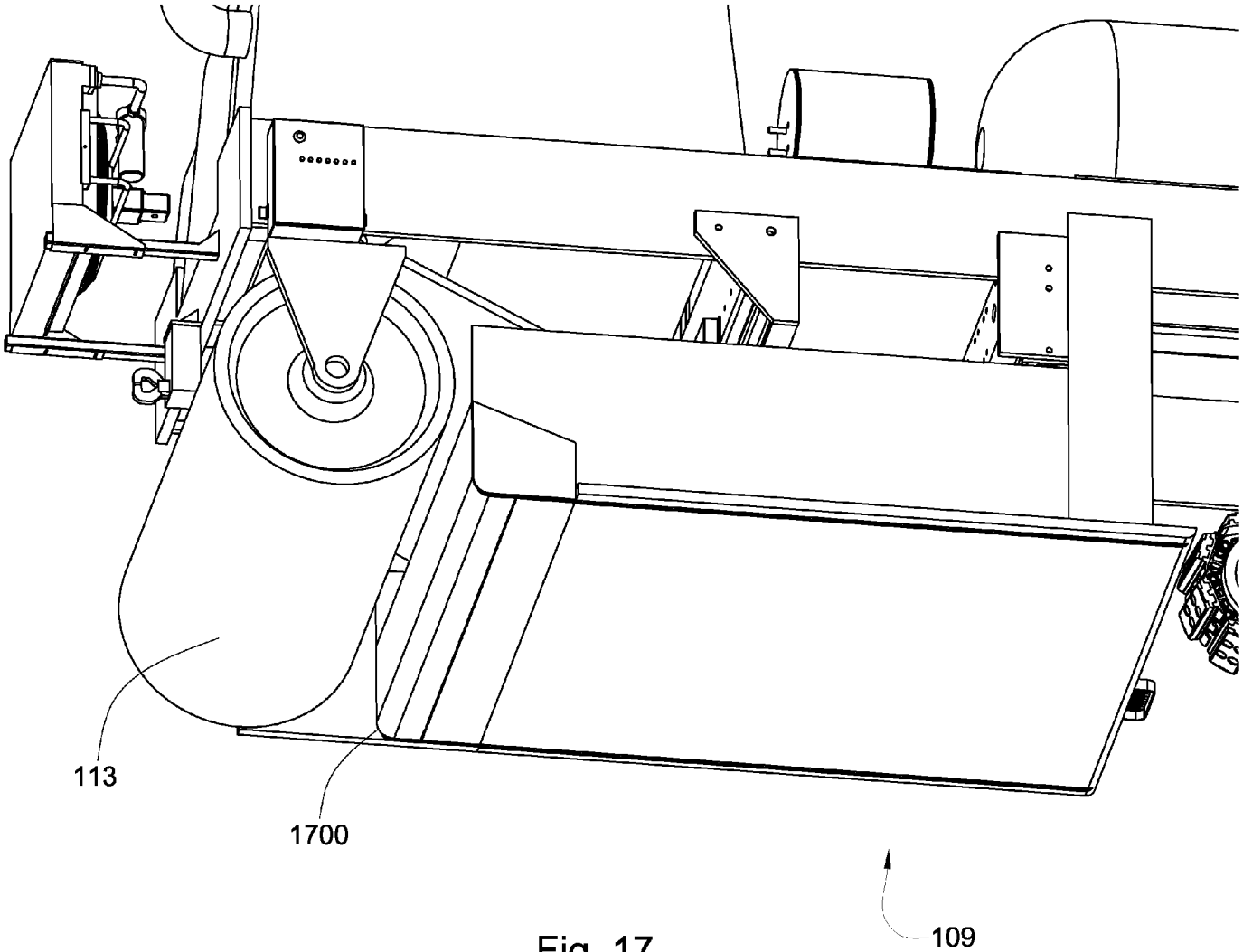
FIG. 17 is a perspective diagram of another embodiment of an asphalt reconditioning machine.

In the embodiment of FIG. 17, a compactor 113 may be proximate a rearward edge 1700 of the manifold 109 such that the asphalt, after being pressurized, is depressurized when it reaches the rearward edge 1700 of the manifold 109 and the compactor 113. The compactor 113 may then level and compact the asphalt into a newly paved surface.

Figure 18:
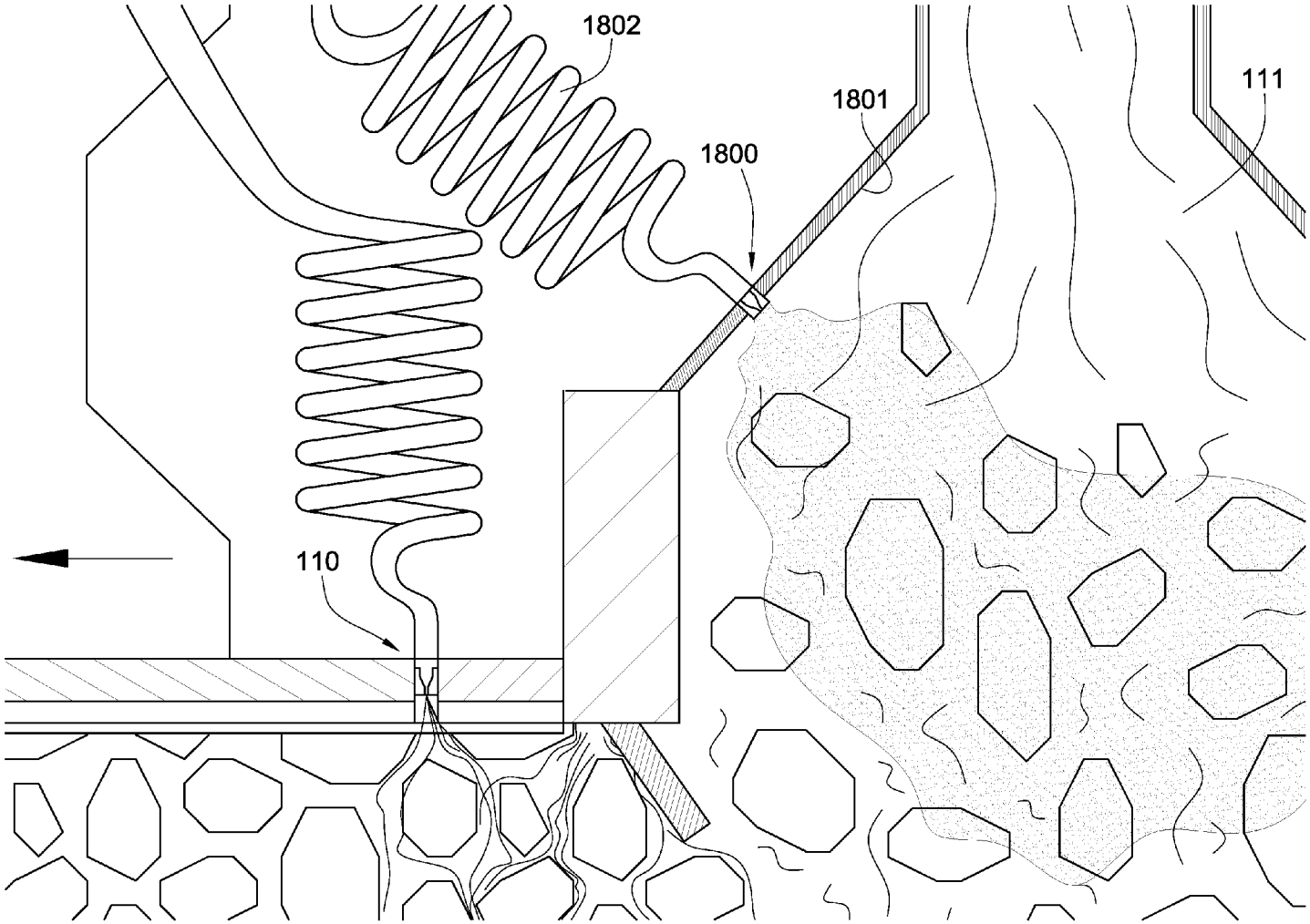
FIG. 18 is a perspective diagram of another embodiment of an asphalt reconditioning machine.

A second plurality of jets 1800 disposed within an inner surface 1801 of the depressurization chamber 111 may be in fluid communication with a second fluid reservoir through a second fluid pathway 1802, as in the embodiment of FIG. 18. The first plurality of jets 110 may emit water in order to pressurize and clean the asphalt surface when the asphalt is depressurized. The second plurality of jets 1800 may emit an asphalt rejuvenation material into the depressurization chamber 111 such that the asphalt is coated with the rejuvenation material while in the depressurization chamber 111.

Figure 19:
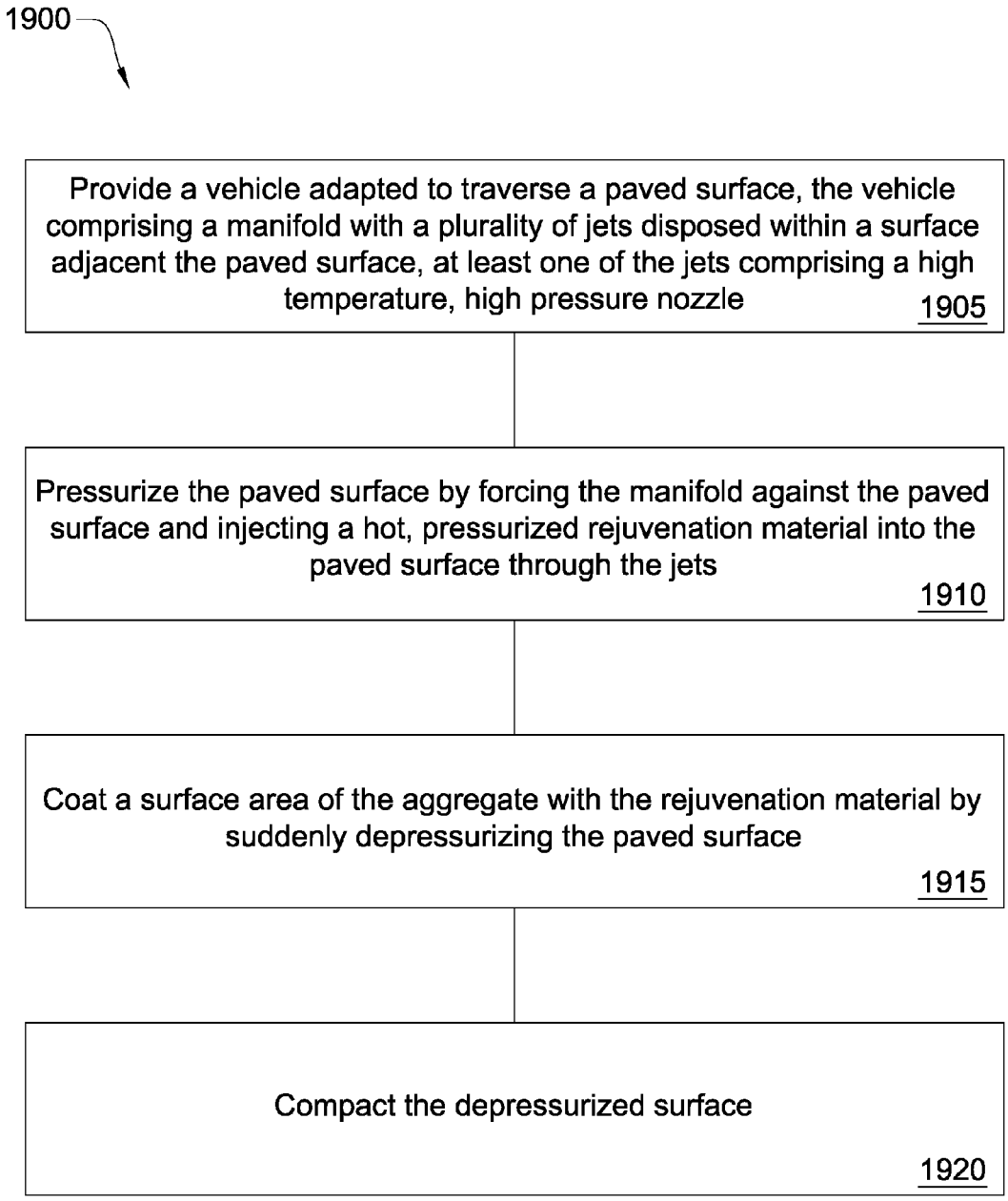
FIG. 19 discloses a method for reconditioning a paved surface of aggregate and asphalt cement.

Referring to FIG. 19, a method 1900 for reconditioning a paved surface of aggregate and asphalt cement comprises the steps of providing 1905 a vehicle adapted to traverse the paved surface; the vehicle comprising a manifold with a plurality of jets disposed within a surface adjacent the paved surface, at least one of the jets comprising a high temperature, high pressure nozzle; pressurizing 1910 the paved surface by forcing the manifold against the paved surface and injecting a hot, pressurized rejuvenation material into the paved surface through the jets; coating 1915 a surface area of the aggregate with the rejuvenation material by suddenly depressurizing the paved surface; and compacting 1920 the depressurized paved surface.

Figure 20:
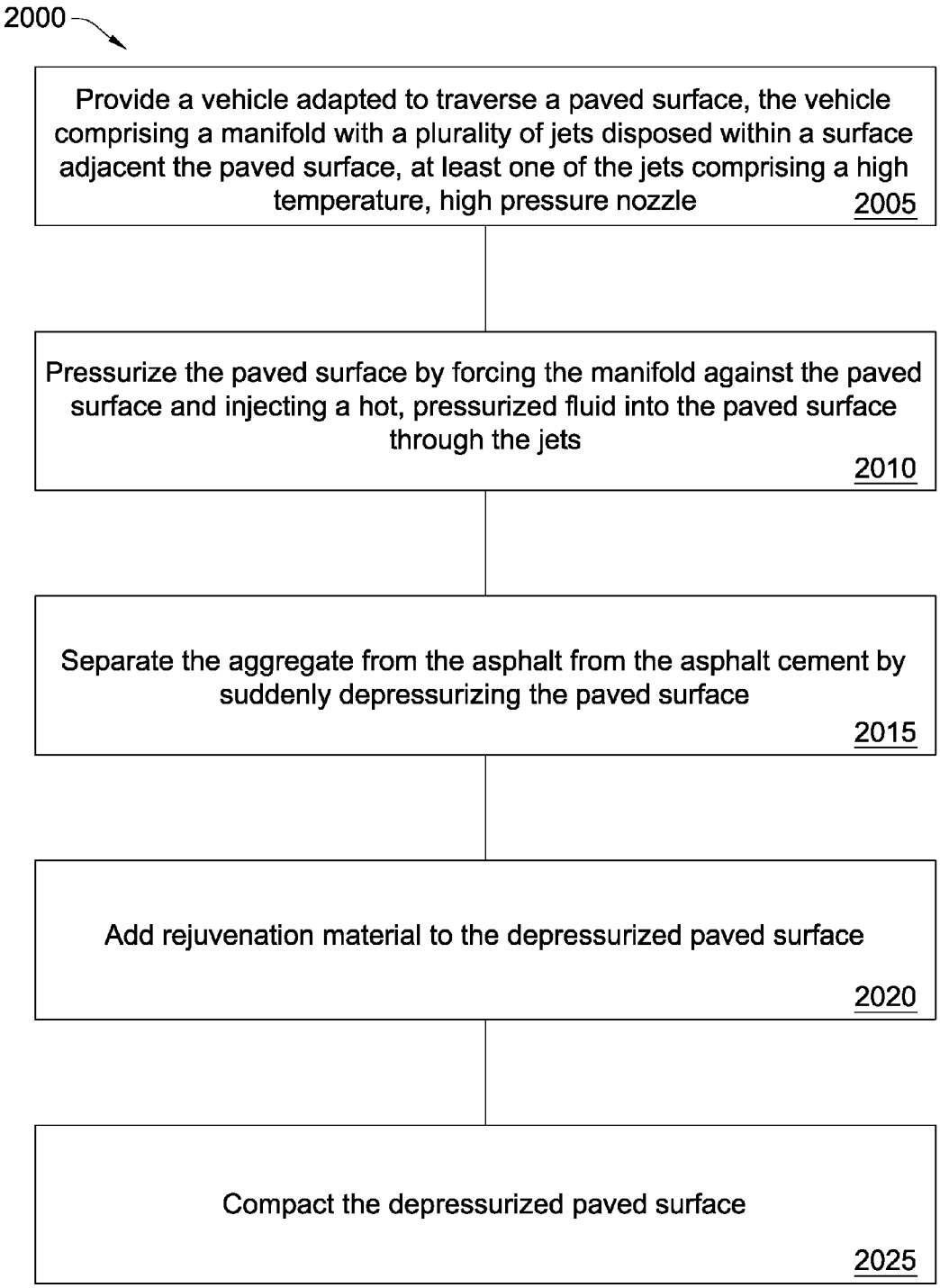
FIG. 20 disclose another method for reconditioning a paved surface of aggregate and asphalt cement.

Referring to FIG. 20, a method 2000 for reconditioning a paved surface of aggregate and asphalt cement comprises the steps of providing 2005 a vehicle adapted to traverse the paved surface; the vehicle comprising a manifold with a plurality of jets disposed within a surface adjacent the paved surface, at least one of the jets comprising a high temperature, high pressure nozzle; pressurizing 2010 the paved surface by forcing the manifold against the paved surface and injecting a hot, pressurized fluid into the paved surface through the jets; separating 2015 the aggregate from the asphalt cement by suddenly depressurizing the paved surface; adding 2020 rejuvenation material to the depressurized paved surface; and compacting 2025 the depressurized paved surface.

Whereas the present invention has been described in particular relation to the drawings attached hereto, it should be understood that other and further modifications apart from those shown or suggested herein, may be made within the scope and spirit of the present invention.

What is claimed is:

1. An apparatus for reconditioning a paved surface, comprising:

a vehicle adapted to traverse the paved surface;

the vehicle comprising a manifold with a plurality of jets disposed within a surface pressed against the paved surface, at least one of the jets comprising a high temperature, high pressure nozzle;

the high temperature, high pressure nozzle comprising a hard material with a hardness of at least 2,000 HK;

the jets being in fluid communication with a fluid reservoir through a fluid pathway; and the fluid pathway comprising a pressurizing mechanism and a heating mechanism for bringing the fluid to a high pressure and a high temperature.

2. The apparatus of claim 1, wherein the vehicle further comprises a compactor.

3. The apparatus of claim 1, wherein the manifold comprises a depressurization chamber rearward of the jets.

4. The apparatus of claim 3, wherein the manifold comprises at least one projection intermediate the jets and the depressurization chamber adapted to further pressurize a portion of the paved surface.

5. The apparatus of claim 1, wherein the pressurizing mechanism is a pump.

6. The apparatus of claim 1, wherein the fluid pathway comprises a check valve.

7. The apparatus of claim 1, wherein the fluid pathway is in communication with a second fluid reservoir.

8. The apparatus of claim 7, wherein the fluid pathway comprises an agitator for mixing fluid from both reservoirs together.

9. The apparatus of claim 7, wherein one of the reservoirs comprises water and the other reservoir comprises oils, maltenes, asphaltenes, surfactants, zeolites, polymers, rubbers, waxes, foaming agents, or combinations thereof.

10. The apparatus of claim 1, wherein the nozzles are flush with the surface of the manifold.

11. The apparatus of claim 1, wherein the nozzle comprises a steel housing with a bore with a first diameter and a second diameter, wherein the second diameter is narrower than the first diameter and the hard material is disposed within the second diameter; the second diameter being adjacent the surface of the manifold.

12. The apparatus of claim 1, wherein a gap exists between the surface of the manifold and nozzle, wherein the gap is less than 10 mm.

13. The apparatus of claim 1, wherein the hard material is selected from the group consisting of diamond, monocrystalline diamond, polycrystalline diamond, sintered diamond, chemical deposited diamond, physically deposited diamond, natural diamond, infiltrated diamond, layered diamond, thermally stable diamond, silicon bonded diamond, metal bonded diamond, cubic boron nitride, silicon carbide, diamond impregnated matrix, diamond, impregnated carbide, and combinations thereof.

14. A method for reconditioning a paved surface of aggregate and asphalt cement comprising the steps of:

providing a vehicle adapted to traverse the paved surface;

the vehicle comprising a manifold with a plurality of jets disposed within a surface adjacent the paved surface, at least one of the jets comprising a high temperature, high pressure nozzle;

pressurizing the paved surface by forcing the manifold against the paved surface and injecting a hot, pressurized rejuvenation material into the paved surface through the jets;

coating a surface area of the aggregate with the rejuvenation material by suddenly depressurizing the paved surface; and compacting the depressurized paved surface.

15. The method of claim 14, wherein the method includes a further step of heating the paved surface before the jets by allowing a portion of the rejuvenation material to turn into steam and travel forward in the direction of the vehicle's travel along the surface of the manifold.

16. The method of claim 14, wherein the depressurizing the paved surface happens behind the manifold or with a depressurization chamber formed in the manifold.

17. The method of claim 14, wherein the method further comprises capturing and condensing a portion of the rejuvenation material during the step of depressurizing the paved surface.

18. The method of claim 17, wherein the remaining portion of the rejuvenation material coats the aggregate of the paved surface.

19. A method for reconditioning a paved surface of aggregate and asphalt cement, comprising the steps of:

providing a vehicle adapted to traverse the paved surface;

the vehicle comprising a manifold with a plurality of jets disposed within a surface adjacent the paved surface, at least one of the jets comprising a high temperature, high pressure nozzle;

pressurizing the paved surface by forcing the manifold against the paved surface and injecting a hot, pressurized fluid into the paved surface through the jets;

separating the aggregate from the asphalt cement by suddenly depressurizing the paved surface;

adding rejuvenation material to the depressurized paved surface; and compacting the depressurized paved surface.

20. The method of claim 19, wherein the step of adding rejuvenation material takes place in a depressurization chamber formed in the manifold.

* * * * *